US009505114B2

(12) United States Patent
Rolfers et al.

(10) Patent No.: US 9,505,114 B2
(45) Date of Patent: Nov. 29, 2016

(54) DEVICE FOR PROVIDING ACCESS TO A SPACE

(75) Inventors: Johannes Willem Rolfers, Emmer-Compascuum (NL); Jitty Hillebranda Struik, Rijswijk (NL)

(73) Assignee: SF Breacher Holding B.V., Enschede (NL)

( * ) Notice: Subject to any disclaimer, the term of this patent is extended or adjusted under 35 U.S.C. 154(b) by 469 days.

(21) Appl. No.: 14/236,518

(22) PCT Filed: Jul. 23, 2012

(86) PCT No.: PCT/NL2012/050527

§ 371 (c)(1),
(2), (4) Date: Apr. 2, 2014

(87) PCT Pub. No.: WO2013/019106

PCT Pub. Date: Feb. 7, 2013

(65) Prior Publication Data

US 2015/0360358 A1 Dec. 17, 2015

(30) Foreign Application Priority Data

Aug. 2, 2011 (NL) ..... 2007212

(51) Int. Cl.
*B25D 9/08* (2006.01)
*B25B 28/00* (2006.01)
(Continued)

(52) U.S. Cl.
CPC ..... *B25B 28/00* (2013.01); *A62B 3/005* (2013.01); *B25D 9/08* (2013.01); *B25D 9/12* (2013.01); *B25F 5/00* (2013.01)

(58) Field of Classification Search
CPC ..... B25D 9/00; B25D 9/08; B25D 9/12; A62B 3/00; A62B 3/005; B25B 28/00; B25F 5/00
USPC ..... 173/90, 204, 202, 206, 207, 152, 141, 173/144, 200, 212, 162.1, 162.2; 254/11, 254/93 R, 104; 29/252, 254, 275; 72/446, 72/453.1
See application file for complete search history.

(56) References Cited

U.S. PATENT DOCUMENTS 2,526,148 A * 10/1950 McLean ..... B66F 3/42 254/93 R
3,370,421 A * 2/1968 Piper ..... B66F 3/42 254/93 R (Continued)

OTHER PUBLICATIONS

PCT/NL2012/050527 International Search Report, Oct. 31, 2012.

(Continued)

*Primary Examiner* — Scott A. Smith
(74) *Attorney, Agent, or Firm* — Oppedahl Patent Law Firm LLC

(57) ABSTRACT

The present invention relates to a device for providing access to a space, wherein the space is provided with an access element, such as for instance a door or window, wherein the device is provided with pressing elements for exerting an impact force on one or more parts of the access element, such as for instance a door frame, comprising:

an elongate housing, an elongate impact element for exerting the impact force on the access element which is adjustably movable between a starting position and an end position by a first drive, the first drive adapted to produce the impact force, the impact element is comprised in a first guide extending along the impact element, the impact element is provided from close to the first outer end up to at least an exit opening with a narrowed portion, the first drive comprises a first fluid reservoir provided with a first fluid suitable for high-pressure application, wherein in the starting position of the impact element the first fluid is arranged compressed in the first fluid reservoir and the first fluid reservoir is in fluid communication with a first side of the first outer end of the impact element, and activating elements for activating the device.

8 Claims, 4 Drawing Sheets

(51) Int. Cl.

| | |
|---|---|
| ***A62B 3/00*** | (2006.01) |
| ***B25D 9/12*** | (2006.01) |
| *B25F 5/00* | (2006.01) |

(56) References Cited

U.S. PATENT DOCUMENTS

| | | | | | |
|---|---|---|---|---|---|
| 3,710,655 | A * | 1/1973 | Brandle | A62B 3/005 | 81/463 |
| 4,850,437 | A * | 7/1989 | Sudnishnikov | B21J 15/18 | 173/13 |
| 4,871,034 | A * | 10/1989 | Schmidt | E02D 7/10 | 173/90 |
| 5,329,685 | A | 7/1994 | Gillespie | | |
| 5,517,740 | A * | 5/1996 | Costlow | B23P 19/025 | 173/17 |
| 5,987,723 | A * | 11/1999 | McNally | A62B 3/005 | 173/141 |
| 6,364,032 | B1 * | 4/2002 | DeCord, Jr. | B25D 9/12 | 173/162.1 |
| 6,932,166 | B1 * | 8/2005 | Kirsch | B22D 31/00 | 173/206 |
| 7,921,531 | B2 * | 4/2011 | Prine | A62B 3/005 | 173/90 |
| 8,418,781 | B2 * | 4/2013 | Chambers | A62B 3/005 | 173/200 |
| 2009/0199613 | A1 | 8/2009 | Krumrei | | |
| 2010/0077585 | A1 | 4/2010 | Prine | | |

OTHER PUBLICATIONS

Written Opinion of Searching Authority, Feb. 4, 2014.

* cited by examiner

DEVICE FOR PROVIDING ACCESS TO A SPACE

TECHNICAL FIELD

The present invention relates to a device for providing access to a space, wherein the space is provided with an access element, such as for instance a door or window, wherein the device is provided with pressing means for exerting an impact force on one or more parts of the access element, such as for instance a door frame, comprising:

an elongate housing, an elongate impact element for exerting the impact force on the access element which is adjustably movable between a starting position and an end position by means of first drive means, the first drive means are adapted to produce the impact force, the impact element is comprised in a first guide extending along the impact element, the impact element is provided from close to the first outer end up to at least an exit opening with a narrowed portion, the first drive means comprise a first fluid reservoir provided with a first fluid suitable for high-pressure application, wherein in the starting position of the impact element the first fluid is arranged compressed in the first fluid reservoir and the first fluid reservoir is in fluid communication with a first side of the first outer end of the impact element, first activating means for activating the device.

BACKGROUND ART

The known devices are used by police units to open doors. Such a device is known in the field. The known device is described in the American patent U.S. Pat. No. 5,987,723. The known device uses explosive drive means. The known device has the drawback that the device produces a very great deal of noise, whereby the element of surprise for those present behind the access element is lost. In addition, the device is difficult to place in the case of doors since the device is difficult to clamp in place.

The use of explosives limits the application of the above stated device since there are not many law enforcement units allowed to make use of explosives. In addition, transport and storage of explosives is subject to strict rules which can in practice form an impediment to use of the device.

Another device according to the preamble is described in the international patent application WO 02/096517. This known device uses hydraulic drive means. The drawback of this device is that the device is slow in use. In addition, the device always requires an external hydraulic pump, whereby the device becomes heavy to use.

Both the known devices have the drawback that the devices are not closed, whereby the operation thereof can be affected by fouling. The deployment of the devices cannot therefore be guaranteed 100%.

The known devices are moreover not suitable for transport under water, whereby marine units cannot use the known devices.

DISCLOSURE OF THE INVENTION

It is the object of the invention to provide a device according to the preamble which does not have the above drawbacks.

The device according to the invention has for this purpose the feature that the device is provided with a dosing device for adjustable dosing of the impact force, wherein the dosing device is arranged substantially in the housing. The device according to the invention can hereby be placed several seconds more quickly than the known device. These seconds are of vital importance to police and marine units.

In a first preferred embodiment of the device according to the invention, the dosing device comprises:

a second fluid reservoir at least partially formed by a space between the first guide and the narrowed portion in the impact element, wherein in the starting position of the impact element the second fluid reservoir is substantially filled with a second fluid suitable for high-pressure application and the second fluid reservoir is adapted to fully absorb the impact force produced by the first drive means, a third fluid reservoir in adjustable fluid communication with the second fluid reservoir, the first activating means are adapted to adjust the extent of fluid communication between the second fluid reservoir and the third fluid reservoir.

The first drive means are formed by the second fluid reservoir filled with the second fluid which is under high pressure. The impact force is in this way always present and need not first be generated. In addition, this embodiment produces hardly any sound. Owing to the applied dosing device the device can be easily clamped in, after which the full impact force can be utilized all at once in order to force the access element.

In a second preferred embodiment of the device according to the invention, the device is provided with (pressure-) relieving means for relieving the device for the purpose of at least partially urging the impact element back in the direction of the starting position to a relieved position, comprising:

a fourth fluid reservoir in direct or indirect fluid communication with the second fluid reservoir and substantially filled with a fourth fluid, second drive means adapted to carry the fourth fluid under high pressure into the fourth fluid reservoir, second activating means for activating the relieving means, wherein the second activating means are adapted to bring about the fluid communication between the fourth fluid reservoir and the second fluid reservoir.

Once the device has been activated and has forced the access element, the device has to be removed as quickly as possible. The police or marine units can hereby enter the space behind the forced access element as quickly as possible. Providing the device with a relieving device enables the device to be moved in simple manner to a relieved position, whereby the device is released from the access element. This measure also results in several seconds being gained during use of the device according to the invention.

In a second preferred embodiment of the device according to the invention, the relieving means comprise a second tubular guide which is provided with a displaceable sealing wall which divides the space in the second guide into a first guide space and a second guide space, wherein the fourth fluid reservoir is comprised in the first guide space, and the second drive means are adapted to displace the sealing wall such that the pressure in the fourth fluid reservoir is increased. Following activation of the second activating means the pressure built up in the fourth fluid reservoir ensures that the second fluid reservoir fills with fluid and the impact element is driven in the direction of the starting position to its relieved position.

In a further preferred embodiment, the second drive means are provided with a fifth fluid reservoir which comprises a fifth fluid suitable for high-pressure application and which is in fluid communication with the second guide space which is substantially filled with the fifth fluid, wherein the fifth fluid in the fifth fluid reservoir is under high pressure in the starting position of the impact element.

The force for urging the impact element to its relieved position is hereby available at all times and need not be built up first.

The first fluid reservoir is preferably comprised wholly gas-tightly in the housing. No gases hereby escape from the device, whereby the device is safer for the user. The device can also be easily made ready for reuse by filling the second and fourth fluid reservoirs with fluid using a compressor.

In addition, the first fluid reservoir can be arranged for releasable gas-tight attachment in the housing. The first fluid reservoir can for instance be embodied as a gas cartridge.

A hydraulic oil is preferably used for the second, third and fourth fluids. A gas is preferably used for the first and second fluids.

The device is preferably provided with locking means for locking the impact element in the starting position.

BRIEF DESCRIPTION OF THE DRAWINGS

The device will be further elucidated with reference to the following figures, in which.

The same reference numerals designate the same components.

BEST MODE FOR CARRYING OUT THE INVENTION

Figure 1A:
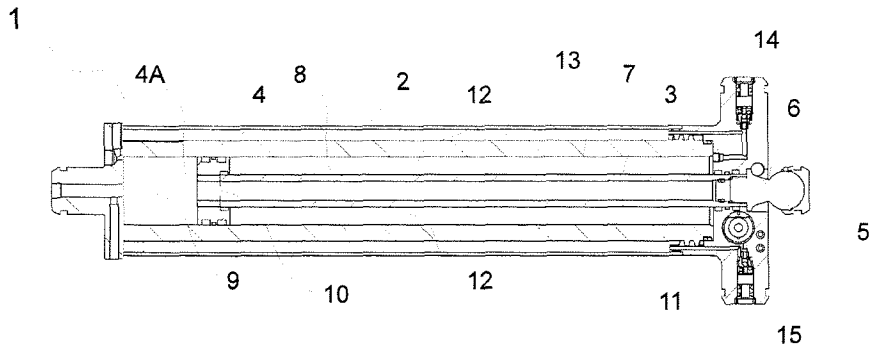
FIG. 1A shows a preferred embodiment of the device according to the invention with the impact element 3 in the starting position.

FIG. 1A shows a preferred embodiment of device 1 according to the invention with impact element 3 in the starting position. Device 1 is intended for placing at or between one or more parts of the access element, such as for instance door frame parts. For this purpose device 1 comprises an elongate housing 2, and an elongate impact element 3 which can be extended out of the housing and is provided with a first outer end 4, which is comprised in housing 2, and a second outer end 5 located substantially outside housing 2. Impact element 3 and an outer end of housing 2 remote from the second outer end are intended to be placed clampingly between one or more parts of an access element, such as a door or a window frame, and/or a fixed object close to the access element, such as for instance a railing. Impact element 3 protrudes via an exit opening 6 from a short side of housing 2, wherein in the starting position impact element 3 is comprised substantially in housing 2 and in an end position (see FIG. 1B) impact element 3 lies further outside housing 2 and in the line thereof. The impact force produced by the drive means is transmitted via the first outer end 4 to the second outer end 5 and, when the device is placed, to the one or more parts of the access element. Impact element 3 is comprised in a first guide 7 which is preferably tubular. First guide 7 extends along impact element 3. The cross-section of first guide 7 and the cross-section of first outer end 4 preferably take co-acting forms so that first outer end 4 can be arranged fluid-tightly in first guide 7 in a simple manner.

Impact element 3 is provided from close to first outer end 4 up to at least an exit opening 6 with a narrowed portion 8 which extends in the line of impact element 3. The cross-section of narrowed portion 8 and the cross-section of exit opening 6 preferably have co-acting forms so that the impact element can be arranged fluid-tightly in exit opening 6 in a simple manner. Impact element 3 can be embodied as a piston. The first drive means comprise a first fluid reservoir 9 provided with a first fluid suitable for high-pressure application, for instance a noble gas such as argon, wherein in the starting position of impact element 3 the first fluid is arranged compressed in fluid reservoir 9 and the first fluid reservoir 9 is in fluid communication with a first side 4A of first outer end 4 of impact element 3. In the described embodiment a passage 10 is arranged in the impact element, although this is not essential for the operation of the invention. Following activation of device 1 the first fluid exerts a force on the first side 4A of first outer end 4 of impact element 3 in the direction of the second end position of impact element 3.

In the case a gas is used, fluid reservoir 9 is preferably under a pressure of 400 bar so that, at a piston diameter of 4 cm, the impact force amounts to 5 tons, this being sufficient to force the access element. In order to ensure that possibly arranged door chains are also broken, the impact element preferably has a length of 30 cm. Following activation of device 1 the first outer end 4 of impact element 3 is displaced through 30 cm in the direction of the end position of impact element 3. In this end position the pressure in the first fluid reservoir 9 has fallen to 170 bar and, at a piston diameter of 4 cm, the remaining impact force at this position amounts to 2.125 tons. This remaining impact force is important for the case the access element is not completely open. Owing to the remaining impact force on the access element the access element remains under tension, whereby the access element can still be opened manually with a kick or by means of a ram. The above stated dimensions and pressure values are stated by way of example. The invention is expressly not limited to these dimensions and pressure values.

Fluid reservoir 9 is preferably built into housing 2 and housing 2 is provided with means for increasing the pressure in the fluid reservoir. Fluid reservoir 9 can however also be arranged removably in housing 2, wherein fluid reservoir 9 is embodied as for instance a gas cartridge.

It is found necessary in practice that the device according to the invention be quick to place. It is necessary here to clamp the device quickly in place, wherein impact element 3 is placed against access element 3 in rapid but controllable manner.

In order to make this possible device 1 comprises a dosing device in housing 2 for dosing the impact force. This dosing device preferably comprises a second fluid reservoir 12 which is formed at least partially by a space between first guide 7 and narrowed portion 8 in impact element 3. The volume of the second fluid reservoir 12 thereby depends on the position of first outer end 4 of impact element 3 relative to exit opening 6. The volume of second fluid reservoir 12 is greatest when impact element 3 is in the starting position. Second fluid reservoir 12 is substantially filled with a second fluid suitable for high-pressure application, for instance a hydraulic oil, whereby the impact force produced by the first drive means can be absorbed.

For the purpose of dosing the impact force produced by the first drive means device 1 is also provided with a third fluid reservoir 13 which is in adjustable fluid communication with second fluid reservoir 12. The volume hereof has at least the volume of second fluid reservoir 12. This third fluid reservoir 13 is intended to receive the second fluid from second fluid reservoir 12, and in the starting position of impact element 3 is substantially filled with a third fluid with the same properties as the second fluid. The second and third fluids can in practice be the same. In the starting position of impact element 3 the third fluid reservoir 13 is under a lower pressure than the second fluid in second fluid reservoir 12. In the end position of impact element 3 the third fluid reservoir 13 has received at least the volume of second fluid from second fluid reservoir 12. This volume equals the volume of the space between first guide 7 and narrowed portion 8 in impact element 3 in the starting position of impact element 3.

It will be evident that exit opening 6 and first outer end 4 are provided all the way around with fluid-sealing means.

In order to operate the dosing device, and thereby device 1, device 1 is provided with first activating means 11 which define the extent of fluid communication between the second 12 and third fluid reservoir 13. These activating means 11 can be embodied as a feed member. By opening the feed member the second fluid will flow to third fluid reservoir 13, whereby impact element 3 is urged to the end position.

Fully opening the feed member will cause impact element 3 to move toward the end position with maximum impact force. Not opening the feed member fully will cause impact element 3 to move at a lower speed to the end position, and impact element 3 can be stopped in an intermediate position by fully closing the feed member.

Figure 1B:
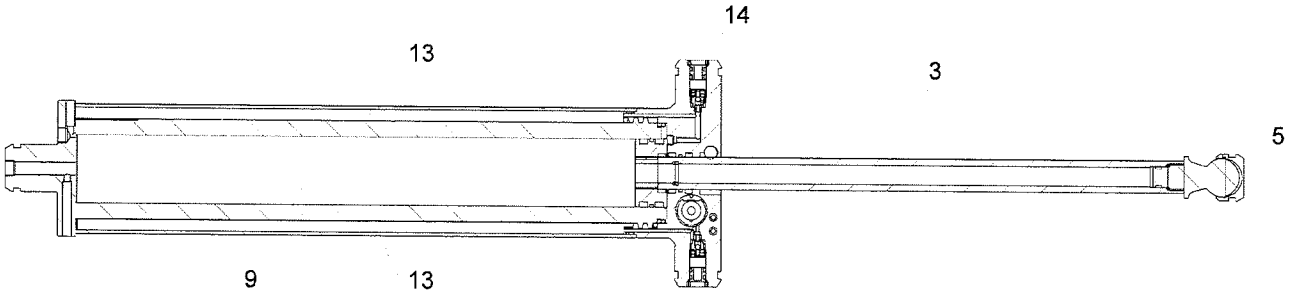
FIG. 1B shows a preferred embodiment of the device according to the invention with the impact element 3 in the end position.

FIG. 1B shows a preferred embodiment of the device according to the invention with impact element 3 in the end position. The second fluid has now been displaced substantially to third fluid reservoir 13, whereby impact element 3 can move to the end position. In order to re-place impact element 3 in its starting position housing 2 is provided with a connection 14 connected to second fluid reservoir 12. Using for instance a fluid compressor (not shown) the second fluid can be fed back again under high pressure to second fluid reservoir 12, wherein impact element 3 is pressed back into the starting position. In the example stated in the description of FIG. 1A this pressure is higher than 400 bar. First liquid reservoir 9 is hereby brought under pressure again.

Figure 2A:
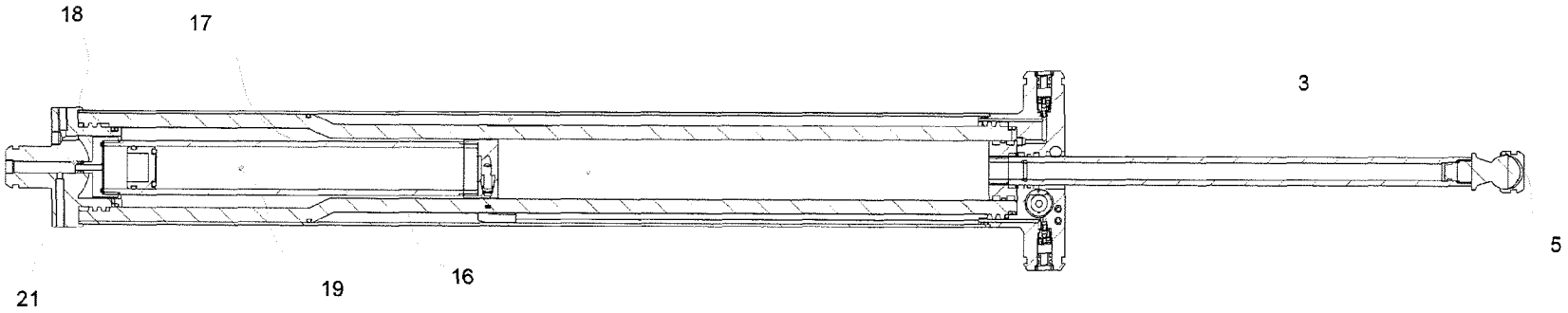
FIG. 2A shows a further preferred embodiment of the device according to the invention with the impact element 3 in an end position, wherein the device is provided with relieving means.

FIG. 2A shows a further preferred embodiment of device 1 according to the invention with impact element 3 in an end position, wherein the device is provided with (pressure-) relieving means. In order to relieve device 1 in the case impact element 3 is clamped between for instance the parts of the access element, device 1 is provided with a relieving means for at least partially urging impact element 3 in the direction of the starting position to a relieved position. The relieving means are formed by, among other parts, a second tubular guide 17 which is provided with a displaceable sealing wall 18 which divides the space in the second guide into a first guide space 19 and a second guide space 20. The first guide space 19 forms a fourth fluid reservoir 16, while the second guide space 20 forms a fifth fluid reservoir 21. The fourth fluid reservoir 16 is in fluid communication with second fluid reservoir 12, preferably via third fluid reservoir 13. Fourth fluid reservoir 16 is preferably filled with the same fluid as the second and third fluid reservoirs, such as for instance hydraulic oil. Fifth fluid reservoir 21 is preferably filled with a gas, for instance a noble gas such as argon, and forms therewith the second drive means.

In the example stated in the description of FIG. 1A the fifth fluid reservoir 21 is preferably brought under a pressure of 700 bar.

Figure 2B:
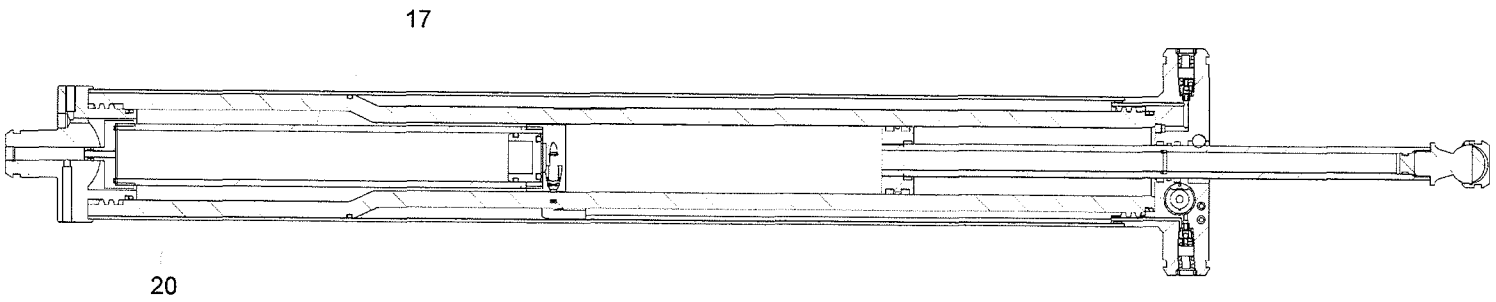
FIG. 2B shows a further preferred embodiment of the device according to the invention with the impact element 3 in a relieved position, wherein the device is provided with relieving means.

FIG. 2B shows a further preferred embodiment of the device according to the invention with impact element 3 in a relieved position, wherein the device is provided with relieving means.

The relieving means can be activated by second activating means which, for the purpose of simple operation of device 1, are integrated into first activating means 11. Following activation of the second activating means the fourth fluid reservoir 16 and the second fluid reservoir 12 are in fluid communication with each other. Owing to the high pressure in the fifth fluid reservoir 21 the fourth fluid is pressed out of the first guide space 19 to second fluid reservoir 12. This can optionally take place via third fluid reservoir 13.

Owing to this fluid displacement the first outer end 4 of impact element 3 will move at least partially in the direction of the starting position to a relieved position. By pumping the fourth fluid back into fourth fluid reservoir 16 via connection 15 the fifth fluid reservoir 21 is brought under pressure again and the relieving means can be used once again.

Third fluid reservoir 13 and/or fourth fluid reservoir 16 preferably also comprise hydraulic oil-absorbing means such as NBR closed-cell rubber for the purpose of filling the reservoirs.

Although the invention has been elucidated above with reference to a number of examples, it will be apparent that it is not limited thereto. The scope of the invention is therefore defined principally by the following claims.

The invention claimed is:

1. A device (1) for providing access to a space, wherein the space is provided with an access element, such as for instance a door or window, wherein the device (1) is provided with pressing means for exerting an impact force on one or more parts of the access element, such as for instance a door frame, comprising:

an elongate housing (2), an elongate impact element (3) for exerting the impact force on the access element which is adjustably movable between a starting position and an end position by means of first drive means, the first drive means are adapted to produce the impact force, the impact element (3) is comprised in a first guide (7) extending along the impact element (3), the impact element (3) is provided from close to the first outer end (4) up to at least an exit opening (6) with a narrowed portion (8), the first drive means comprise a first fluid reservoir (9) provided with a first fluid suitable for high-pressure application, wherein in the starting position of the impact element (3) the first fluid is arranged compressed in the first fluid reservoir (9) and the first fluid reservoir (9) is in fluid communication with a first side (4A) of the first outer end (4) of the impact element (3), first activating means (11) for activating the device (1), characterized in that the device (1) is provided with a dosing device for adjustable dosing of the impact force, wherein the dosing device is arranged substantially in the housing (2) and wherein the dosing device comprises:

a second fluid reservoir (12) at least partially formed by a space between the first guide (7) and the narrowed portion (8) in the impact element (3), wherein in the starting position of the impact element (3) the second fluid reservoir (12) is substantially filled with a second fluid suitable for high-pressure application and the second fluid reservoir (12) is adapted to fully absorb the impact force produced by the first drive means, a third fluid reservoir (13) in adjustable fluid communication with the second fluid reservoir (12), the first activating means (11) are adapted to adjust the extent of fluid communication between the second fluid reservoir (12) and the third fluid reservoir (13).

2. A device (1) as claimed in claim 1, wherein the device (1) is provided with (pressure-)relieving means for relieving the device (1) for the purpose of at least partially urging the impact element (3) back in the direction of the starting position to a relieved position, comprising:

a fourth fluid reservoir (16) in direct or indirect fluid communication with the second fluid reservoir (12) and substantially filled with a fourth fluid, second drive means adapted to carry the fourth fluid under high pressure into the fourth fluid reservoir (16), second activating means for activating the relieving means, wherein the second activating means are adapted to bring about the fluid communication between the fourth fluid reservoir (16) and the second fluid reservoir (12).

3. A device (1) as claimed in claim 2, wherein the relieving means comprise: a second tubular guide (17) which is provided with a displaceablc scaling wall (18) which divides the space in the second guide into a first guide space (19) and a second guide space (20), wherein the fourth fluid reservoir (16) is comprised in the first guide space (19), and the second drive means are adapted to displace the sealing wall (18) such that the pressure in the fourth fluid reservoir (16) is increased.

4. A device (1) as claimed in claim 3, wherein the second drive means are provided with a fifth fluid reservoir which comprises a fifth fluid suitable for high-pressure application and which is in fluid communication with the second guide space (20) which is substantially filled with the fifth fluid, wherein the fifth fluid in the fifth fluid reservoir is under high pressure in the starting position of the impact clement (3).

5. A device (1) as claimed in claim 1, wherein the first fluid reservoir (9) is comprised wholly gas-tightly in the housing (2).

6. A device (1) as claimed in claim 1, wherein the first fluid reservoir (9) can be attached releasably in gas-tight manner in the housing (2).

7. A device (1) as claimed in claim 1, wherein the first and fifth fluids comprise a gas and the second, third and fourth fluids comprise a hydraulic oil.

8. A device (1) as claimed in claim 1, wherein the device (1) is provided with locking means for locking the impact element (3) in the starting position.

* * * * *